US005572819A

United States Patent [19]

Topinka et al.

[11] Patent Number: 5,572,819

[45] Date of Patent: Nov. 12, 1996

[54] LIGHT BULB OR LIGHTING ELEMENT PROTECTOR APPARATUS WITH ROTATABLY ADJUSTABLE CAGE ASSEMBLY AND WHICH PROVIDES INFORMATION

[76] Inventors: Ferdinand Topinka, 23 Louise Ct., Allendale, N.J. 07401; John A. Jeneral, 16 Ridgecrest Cir., Westfield, Mass. 01085

[21] Appl. No.: 296,304

[22] Filed: Aug. 25, 1994

[51] Int. Cl.[6] ..... G09F 13/06

[52] U.S. Cl. ..... 40/570; 40/553; 362/376; 362/84; 362/812

[58] Field of Search ..... 362/376, 377, 362/378, 344, 255, 84, 812; 40/570, 541, 553, 554

[56] References Cited

U.S. PATENT DOCUMENTS

| | | | |
|---|---|---|---|
| 391,950 | 10/1888 | Dubey | 362/376 |
| 913,048 | 2/1909 | Phelps | 40/553 |
| 3,819,930 | 6/1974 | Lamont | 362/378 |
| 3,826,912 | 7/1974 | Pomroy | 362/378 |
| 3,935,560 | 1/1976 | Dorn | 362/378 |
| 4,136,381 | 1/1979 | Bone | 362/344 |
| 4,141,062 | 2/1979 | Trueblood | 362/378 |
| 4,791,541 | 12/1988 | Simmons | 362/378 |
| 5,154,511 | 10/1992 | Veneskey | 362/376 |

*Primary Examiner*—Denise Gromada
*Assistant Examiner*—Sara Sachie Raab
*Attorney, Agent, or Firm*—Fishman, Dionne & Cantor

[57] ABSTRACT

A light bulb or lighting element protector apparatus is disclosed which comprises a socket assembly, a cage assembly, wherein the cage assembly further comprises a means for protecting a light bulb, a message area wherein the message area is located on the cage assembly, a word, a message or a logo wherein the word, message or logo is located on or in the message area, and a means for latching the cage assembly to the socket assembly. The light bulb or lighting element protector apparatus may also comprise a socket assembly, wherein the socket assembly comprises a ribbed portion and a cage assembly, wherein the cage assembly further comprises a means for protecting a light bulb, a message area, wherein the message area is located on the cage assembly, a word, a message or a logo, wherein the word, message, or logo is located on or in the message area, and a means for latching the cage assembly to the socket assembly, wherein the latching means further comprises ribbed portions which interengage with the ribbed portion of the socket assembly. The latching means and the socket assembly are movable and/or rotatable relative to each other.

6 Claims, 10 Drawing Sheets

LIGHT BULB OR LIGHTING ELEMENT PROTECTOR APPARATUS WITH ROTATABLY ADJUSTABLE CAGE ASSEMBLY AND WHICH PROVIDES INFORMATION

FIELD OF THE INVENTION

The present invention is related to a light protector apparatus, and in particular, to a light bulb or lighting element protector apparatus which has a rotatably adjustable cage assembly and which provides information.

BACKGROUND OF THE INVENTION

Light bulb protectors and light protector assemblies are known which provide a protective cover for light bulbs and other lighting element or devices. These light bulb or lighting element protectors provide a means by which to prevent a person or object from striking or coming into contact with the light bulb or lighting element, such as in construction areas, spaces having low ceilings, or other similar environments, etc, wherein it is possible for an exposed light bulb or lighting element to be struck and possibly destroyed and which may further result in injury to individuals, damage to property, and possibly, other unsafe and/or hazardous conditions.

While light bulb protectors are known which may be assembled by a user or by an installer, such known protectors are passive in nature, meaning, that once they are installed, they remain as installed and only serve the function of supplying lighting or illumination in locations where they are being employed. Aside from supplying a protective barrier for a light bulb or lighting element, the known light bulb protectors provide no additional utility.

As a result of the shortcomings of the prior art, there is a need for a light bulb or lighting element protector which serves to provide a variety of other useful functions. In this regard, there is a need for light bulb or lighting element protectors which serve to provide informative, directional and/or warning messages and information thereon while also providing protection for the light bulb or lighting element. There is also a need for having a light bulb or lighting element protector which has a protective cage which is rotatable about a central location such as, for example, a light bulb socket or lighting element power supply, so that the light bulb or lighting element protector may be adjustably and rotatably used for providing, in addition to the above described information, information regarding directional and/or emergency safety information.

SUMMARY OF THE INVENTION

It is an object of the present invention to provide a light bulb or lighting element protector apparatus which serves to overcome the shortcomings of the prior art light bulb and lighting element protectors.

The light bulb or lighting element protector apparatus, which is the subject of the present invention, comprises a rotatably adjustable protective light bulb cage assembly. The cage assembly may be made of a durable flexible plastic material which is capable of withstanding temperature extremes such as extreme heat, such as is emitted from a light bulb or other lighting element, or extreme cold, such as in subfreezing environments. The cage assembly may also be formed of a molded plastic material. The cage assembly may also be made in any one of a variety of colors and may be made from a fluorescent and/or phosphorescent material, which may serve to provide for a continuous illumination of the cage assembly when a light bulb or lighting element is turned off.

The cage assembly should, preferably, also be capable of maintaining its structural integrity in and during adverse, and possibly violent, environments and occurrences so as to provide ample protection for the light bulb or lighting element which it is utilized in conjunction with. The cage assembly may also have a certain degree of flexibility, so that it may be assembled from a one piece molded assembly and, further, so that it may absorb and withstand certain stresses and shocks which it may be subject to during use, without breaking.

The light bulb or lighting element protector apparatus further comprises a socket assembly into which the light bulb or lighting element may be inserted, thereby facilitating its connection to an electrical power source or supply. The cage assembly is rotatable relative to the socket assembly. The cage assembly and the socket assembly may also be designed so as to provide for a racthet-like mechanism or assembly so that the cage assembly may be adjustably rotated, and positioned, about and relative to, the socket assembly.

The socket assembly is to be connected to an electrical power source or supply via electrical wires, or via an electrical power line or cord, which is attached thereto.

The light bulb or lighting element protector cage assembly has, on a top end thereof, adjacent to the socket assembly, a latching device which latching device may be constructed integrally with, and may be form molded with, the cage assembly. The latching device provides a means by which to rotatably connect and/or secure the cage assembly to the socket assembly.

The cage assembly further comprises a message area in which a message and/or a logo may be molded integrally therewith or placed thereinto. Any one of a number of words and/or messages, including emergency messages and/or warnings, may be used in conjunction with the apparatus of the present invention so as to provide and/or to convey any desired message and/or information by the light bulb or lighting element protector apparatus. The cage assembly further comprises a direction indicator, which may be an arrow assembly, which may comprise an arrow tip(s) and an arrow tail(s).

The cage assembly comprises two side half portions which may be connected together via a flexible connector. The side half portions may also have a connecting device connected thereto, A latching device should also be connected to one of the side half portions.

The latching device may be comprised of a stationary section, which may be fixedly connected to, or molded integrally with, one of the side half portions of the cage assembly. The stationary section of the latching device may have, at one end thereof, a connector device. The movable section may have a connecting device connected thereto, which may be designed to mate with the connector device of the stationary section when the latching device is closed about and/or secured to the socket assembly.

The cage assembly may further comprise protective bars and/or rib elements and cross pieces or cross elements which may be constructed integrally with the cage assembly. While the cage assembly may be constructed from a single mold and from a single molding process, it is also possible for the cage assembly to be constructed from individual components. The cage assembly may also be constructed of any one or more of a rigid plastic, a hard rubber, a metal, a steel, or any other suitable material. It is also possible to have removable and/or interchangeable messages, logos and direction indictors which may be utilized in conjunction with the cage assembly. It is also possible to manufacture and/or construct the cage assembly from a fluorescent and/or a phosphorescent color or material so that the cage assembly may provide for an illumination or a glow-in-the-dark protecter when electrical power to the light bulb or lighting element may be interrupted or shut down.

The socket assembly comprises a socket body which has electric wires connected thereto. It is also envisioned that an electrical cord or line may be connected to the socket body. The socket assembly further comprises a midsection which contains a plurality of ribs about at least along a portion of the circumference thereof. The diameter of the rims should facilitate the engagement, and the support, of the socket assembly with the latching device of the cage assembly.

the ribs of the socket assembly should be chosen and designed so that they will coact with, and to interengage with, the ribs of the latching device ofthe cage assembly.

The socket assembly further comprises an electrical socket having an electrical contact(s), into which the light bulb or lighting element may be inserted and secured thereto so as to connect the light bulb or light element to an electrical power source.

The dimensions of the socket assembly and the connecting sections of the latching device should be selected and designed so that the latching device and, therefore, the cage assembly can be secured, about and to, the socket assembly. The dimensions of the ribs of the latching device should, however, provide for enough play and/or leeway so that the cage assembly may be rotatable in either direction, about and with respect to, the socket assembly. So as to provide for a ratchet-like mechanism.

The light bulb or lighting element protector apparatus of the present invention may be assembled as follows. Initially, the light bulb or lighting element must be inserted and secured within the socket of the socket assembly. The latching device sections of the cage assembly may then be brought together and secured together about the socket assembly.

The side half portions of the cage assembly may then be folded together about the flexible connector section. The connecting device of the side half portion, may then be secured to the latching device.

With the light bulb or light element protector apparatus assembled, the cage assembly, with its attendant message and/or logo and directional components and/or elements, may then be rotated about the socket assembly so as to provide and convey informative and/or directional information to those who may see or who may come into the vicinity of the light bulb or lighting element protector apparatus.

The light bulb or lighting element protector apparatus may be utilized to provide protection for the light bulb or lighting element while providing informative and/or directional instructions and/or information. The light bulb or lighting element protector apparatus may be utilized in construction areas, work zones, or in other areas, for providing informative and directional information. A plurality of the apparatuses of the present invention may also be utilized in conjunction with one another so as to designate a pathway of information, such as a pathway to a safe exit in a corridor or in a construction area. The apparatus may also be used to designate a pedestrian walkway. If an alternate or a different direction or pathway is then desired, the cage assembly may be easily rotated so as to indicate the different or new direction. The cage assembly may also be rotated at will so as to allow for the display of a message and/or logo and/or so as to provide a directional indicator for any one or more of a number or directions.

The apparatus of the present invention may be employed so as to provide a lighted pathway or path in a dark corridor, and may then be re-oriented or rotated so as to indicate a new or a different pathway when so desired. Since the cage assembly may be constructed of a fluorescent and/or a phosphorescent color or material, it may provide illumination in the dark after a light has been turned off.

In an alternate embodiment of the light bulb or lighting element protector apparatus of the present invention, the apparatus may further comprise a flashing device which may be connected to any of the power source, the socket assembly, or to any other component or location of or in the lighting circuitry. The flashing device may also be built into the socket assembly. The flashing device may provide a means by which to facilitate a flashing and/or a strobing of the light bulb or lighting element so as to provide for an enhanced message and/or warning indicator.

Accordingly, it is an object of the present invention to provide a light bulb or lighting element protector apparatus which has a rotatably adjustable cage assembly and which provides information.

It is another object of the present invention to provide a light bulb or lighting element protector apparatus which provides directional information.

It is another object of the present invention to provide a light bulb or lighting element protector apparatus which has a cage assembly latching device, which is utilized in conjunction with a ratched light bulb or lighting element socket assembly, so as to provide a ratchet-like rotating mechanism or assembly for rotating the cage assembly about and relative to the socket assembly.

It is yet another object of the present invention to provide a light bulb or lighting element protector apparatus which is made from any one or more of a variety of colors.

It is yet another object of the present invention to provide a light bulb or lighting element protector apparatus which is made from a fluorescent and/or a phosphorescent color so as to provide for cage assembly illumination in the absence of light.

It is yet another object of the present invention to provide a light bulb or lighting element protector apparatus which has removable and/or interchangeable messages and/or logos and/or directional components and elements.

It is still another object of the present invention to provide a light bulb or lighting element protector apparatus which provides for a flashing and/or a strobing light illumination.

Other objects and advantages of the present invention will be made evident to those skilled in the art upon a review of the Description of the Preferred Embodiment taken in conjunction with the Drawings which follow.

DESCRIPTION OF THE PREFERRED EMBODIMENT

Figure 1:
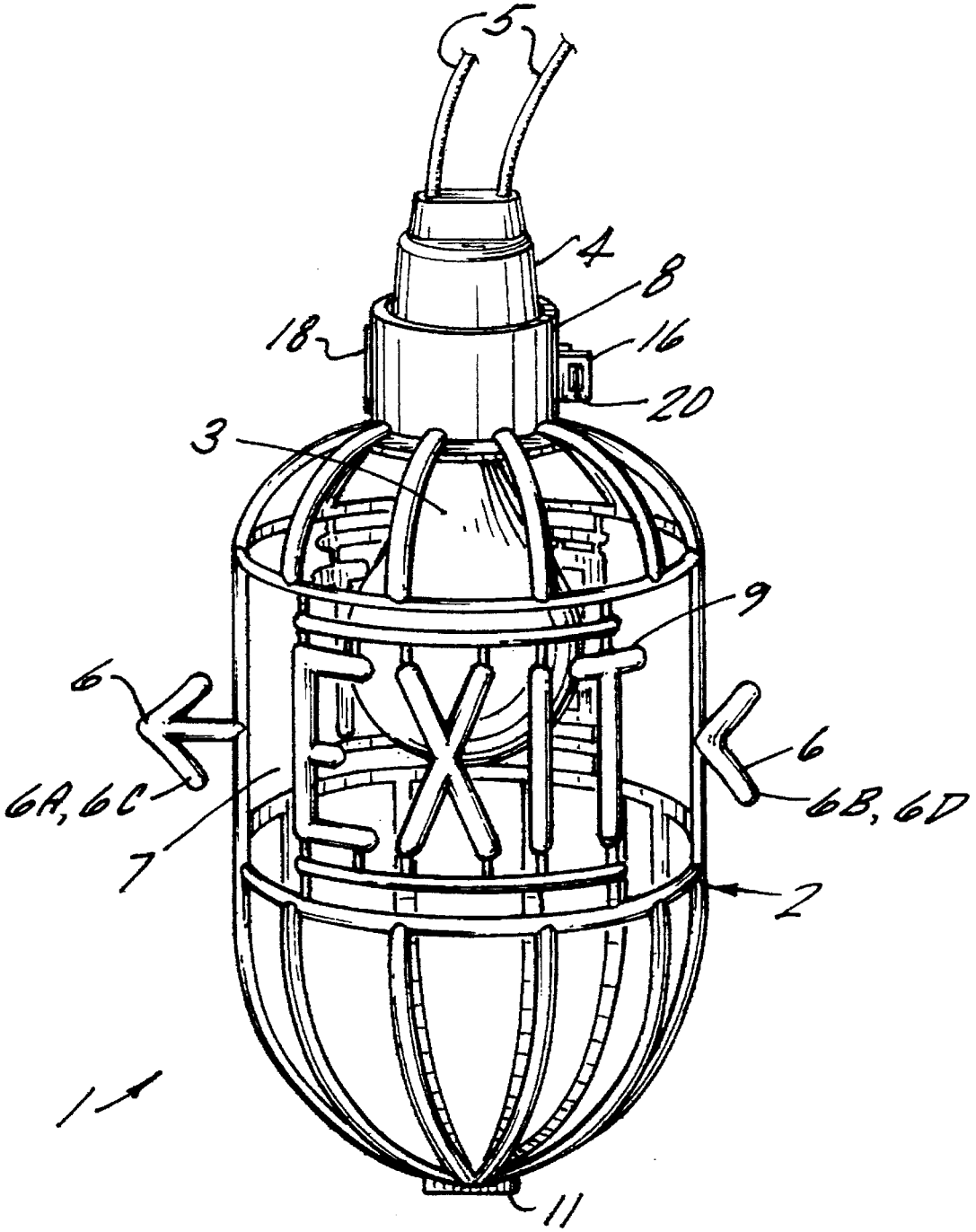
FIG. 1 illustrates a perspective view of the light bulb or lighting element protector apparatus which is the subject of the present invention.

FIG. 1 illustrates a perspective view of the light bulb or lighting element protector apparatus, which is the subject of the present invention, and which is denoted generally by the reference numeral 1. With reference to FIG. 1, the light bulb or lighting element protector apparatus 1 (hereinafter "light protector apparatus 1") comprises a protective cage assembly 2 which, in the preferred embodiment, is made of a durable flexible plastic material which is capable of withstanding temperature variations and extremes such as extreme heat which is emitted from a light bulb or other lighting device, or extreme cold such as in below freezing environments.

The cage assembly may be formed of a molded plastic material. The cage assembly 2 may be made in any one of a variety of colors and may also be made of a fluorescent and/or a phosphorescent color or material. In the preferred embodiment, the cage assembly 2 is made from a plastic fluorescent and/or phosphorescent color or material which serves to provide for a continuous cage assembly illumination when a light bulb or lighting element has been turned off. In this regard, the cage assembly 2 will provide for a "glow in the dark" apparatus.

The cage assembly 2 should preferably be capable of maintaining its structural integrity in adverse, and/or possibly violent, environments or under other adverse environmental conditions, so as to provide ample protection for a light bulb or lighting element which is utilized with the light protector apparatus 1. The cage assembly 2, in the preferred embodiment, should also have a certain degree of flexibility, so that it may be assembled from a one piece molded plastic assembly and process and, further, so that it may be capable of absorbing and withstanding certain stresses and shocks which may result from use, without breaking. In this regard, the apparatus 1 also serves as a safety device.

The light protector apparatus 1 further comprises a socket assembly 4, into which a light bulb or lighting element 3 is inserted, thereby facilitating its connection to an electrical power supply or source. The cage assembly 2, in the preferred embodiment, is rotatable relative to, and about, the socket assembly 4. The cage assembly 2 and the socket assembly 4, in the preferred embodiment, are designed so that, in combination, their elements provide for a ratchet-like mechanism or assembly, so that the cage assembly 2 may be adjustably rotated and positioned, relative to, and about, the socket assembly 4. The socket assembly 4 is connected to an electrical power source or supply by an electric wires 5, which are attached to, and connected with the socket assembly 4, as shown. In the preferred embodiment, two electric wires 5 are utilized. It is also envisioned that an electrical cord or line may also be utilized in conjunction with the apparatus 1. The cage assembly 2 further comprises, on the top end thereof, adjacent to the socket assembly 4, a latching device 8. In the preferred embodiment, the latching device 8 is constructed integrally with the cage assembly 2 and provides a means by which to connect and/or to attach the cage assembly 2 to the socket assembly 4 in the manner which is described hereinbelow.

With further reference to FIG. 1, the cage assembly 2 further comprises a direction indicator, the components of which are collectively indicated by the reference numeral 6. In the preferred embodiment, the direction indicator 6 is an arrow assembly, which is comprised of an arrow tip(s) 6A, 6C and an arrow tail(s) 6B, 6D, as shown. The cage assembly 2 further comprises a message and/or logo area 7 which has a message and/or logo 9 which is molded integrally with the cage assembly 2. In the preferred embodiment, the message and/or logo 9 is the word "EXIT". However, other terms, words or messages may also be used with the cage assembly 2 and the light protector apparatus 1 of the present invention, and may include the words "DANGER", "BEWARE", "CAUTION", "HOT", "STOP", "ENTER", etc. , which terms, words, or messages may be chosen so as to provide informative information and/or any other desired message or indication which is intended to be provided and/or conveyed by the light protector apparatus 1.

Figure 2A:
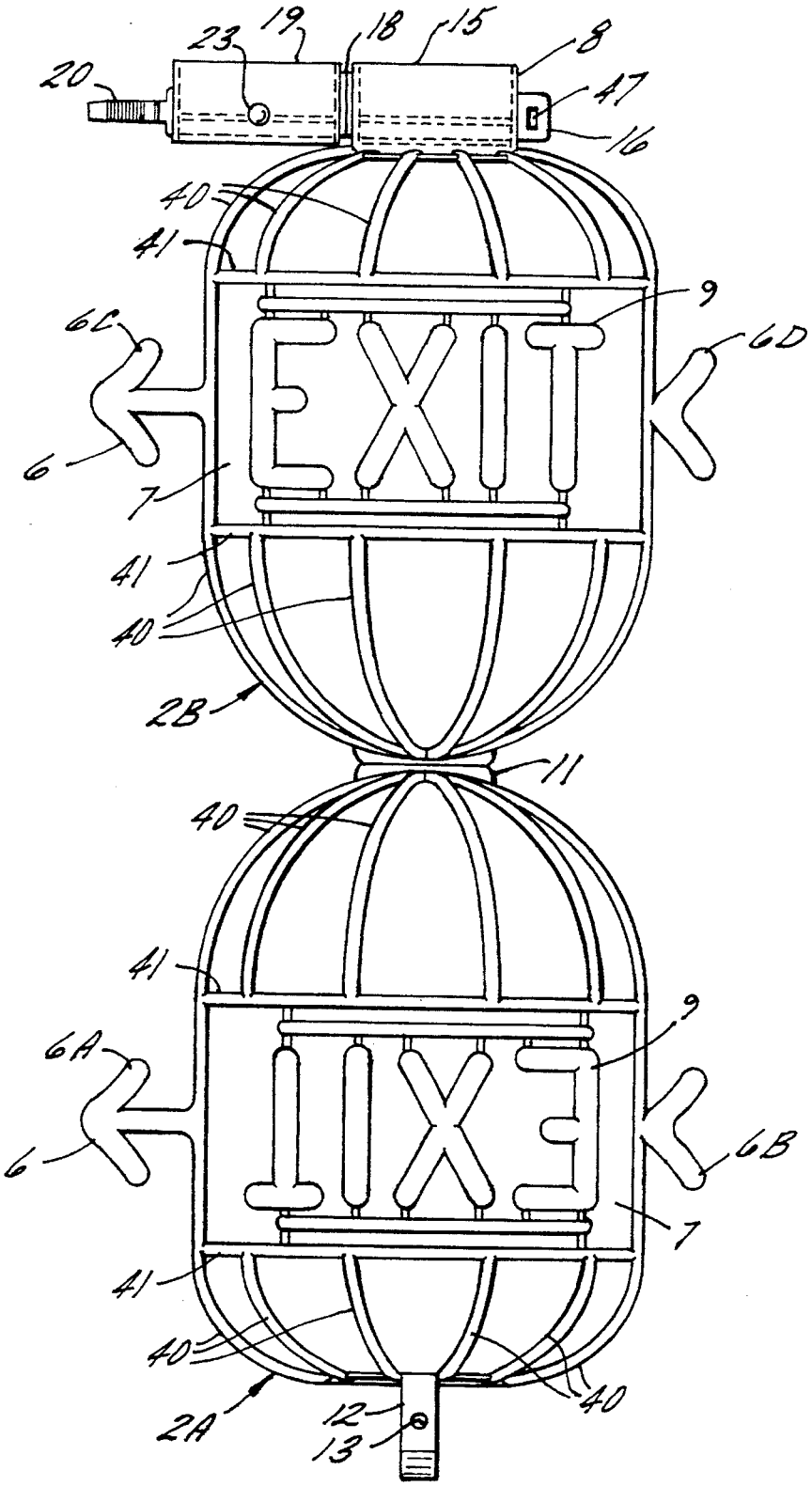
FIG. 2A illustrates a top view perspective of an assembled cage assembly which is used in conjunction with the apparatus of the present invention.

FIGS. 2A–2D illustrate, in greater detail, the cage assembly 2 and its component parts, in a pre-assembled condition. In FIG. 2A, the cage assembly 2 is illustrated, in its pre-assembled condition, from a top view perspective. With reference to FIG. 2A, the cage assembly 2 comprises side half portions 2A and 2B. The side half portions 2A and 2B are connected together by a flexible connector 11. The cage assembly 2 further comprises the direction indicating components 6A, 6B, and 6C, 6D, which comprise the direction indicator 6, which in the preferred embodiment, is an arrow.

As seen in FIG. 2A, arrow tip 6A and arrow tail 6B are formed on cage assembly side half portion 2A and arrow tip 6C and arrow tail 6D are formed on the cage assembly side half portion 2B. The cage assembly 2 also comprises message areas 7 on each side half portion which have, located therein or thereon, a molded word, message or logo 9. In the preferred embodiment, the message or word "EXIT" is utilized. It is, however, important to note that any suitable word, message and/or logo such as "DANGER", "BEWARE", "CAUTION", "HOT", "STOP", "ENTER", etc. , may also be utilized in conjunction with the cage assembly 2 of the apparatus 1.

Side half portion 2A has a connector 12 attached thereto at its end opposite the flexible connector 11. Connector 12 has a connecting hole 13 which is located thereon and therethrough as shown in FIG. 2A. Side half portion 2B has a latching device 8 attached thereto on its end opposite the flexible connector 11. It is important to note that the messages and/or logos 9, which are located in each of the message areas 7 of the cage assembly 2, are oriented, on each of their respective side half portions 2A and 2B, so that the orientation of the messages and/or logos 9 will coincide with each other when the light protector apparatus 1 is in its fully assembled state as shown in FIG. 1.

With reference once again to FIG. 2A, the latching device 8 is comprised of a stationary section 15, which is fixedly attached to, or molded integrally with, the side half portion 2B of the cage assembly 2. The stationary section 15 of the latching device 8 has attached thereto, at one end thereof, a connector 16, which has a rectangular mating hole 47 thereon and therethrough. On the end of the stationary section 15 opposite the end having the connector 16, there is attached to the stationary section 15, via a flexible connector 18, a movable section 19. The movable section 19 has connected thereto, at its end opposite the flexible connector 18, a connecting device 20 which is designed to mate with the rectangular hole 47 of the connector 16, of the stationary section 15, when the latching device 8 is closed about the socket assembly 4 as is described hereinbelow.

A connecting stud 23 is located on the movable section 19. The connecting stud 23 is designed so as to be fastenably mated with the connecting hole 13 which is located on and through the connecting device 12, when the side half portions 2A and 2B of the cage assembly 2 are brought together in the manner described hereinbelow.

Referring once again to FIG. 2A, the cage assembly 2 comprises protective bars or ribs 40 and cross pieces 41 which are constructed integrally with the cage assembly 2. In the preferred embodiment, the cage assembly 2 of FIG. 2A is constructed from a single molded plastic assembly which may be molded in a single molding process. It is, however, important to note that the cage assembly 2 may be constructed from individual components. In this manner, any of the above-described components and/or elements of the cage assembly 2 may be made separately and with the cage assembly 2 constructed from same.

The cage assembly 2 may also be constructed of or at least any one of a rigid plastic, a hard rubber, a metal, a steel, or any other suitable material. It is also possible to have messages and/or logos 9 which are removable and/or interchangeable so that the messages and/or logos 9 may be removed and/or changed so as to provide for a more versatile apparatus 1. It is also possible to have removable directional components and elements so as to facilitate other indication means and/or alternate uses. As noted above, it is possible to manufacture the cage assembly 2 in any one or more of a variety of colors, which may also include fluorescent and/or phosphorescent colors so as to facilitate a "glow-in-the-dark" illumination of the cage assembly 2 should electrical power, and, therefore, lighting be shut off, lost, or interrupted.

Figure 2B:
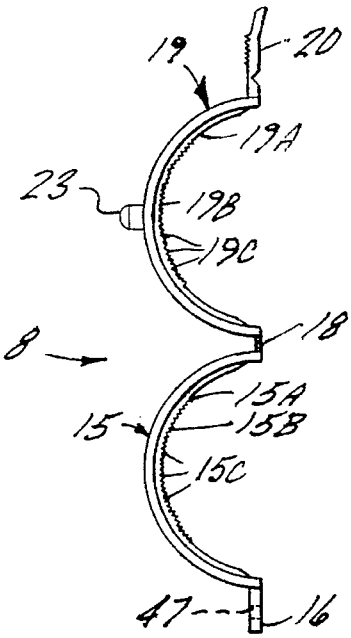
FIG. 2B illustrates a side view perspective of the latching device which is used in conjunction with the cage assembly of FIG. 2A.
Figure 2C:
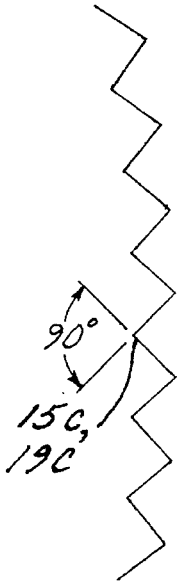
FIG. 2C illustrates a magnified view of the ribs of the latching device of FIG. 2B.

FIG. 2B illustrates a side view perspective of the latching device 8 of the cage assembly 2. As seen from FIG. 2B, each one of the stationary connector 15 and the movable connector 19 has located, on the inner regions thereof, inner connecting regions 15A and 19A, respectively, as shown. The inner connecting regions 15A and 19A comprise ribbed connecting sections 15B and 19B, respectively, which extend, at least along a portion thereof as shown in FIG. 2B. The ribbed connecting sections 15B and 19B, respectively, comprise a plurality of individual ribs 15C and 19C, respectively, which extend along and form the ribbed connecting sections 15B and 19B, respectively. FIG. 2C illustrates a magnified view of the ribs 15C, 19C of FIG. 2B. In the preferred embodiment, the ribs 15C and 19C are formed having 90°angles, which project away from each of the connecting sections 15 and 19, respectively, as shown. It is also important to note, however, that the ribs 15C and 19C may also be formed having any other angle dimension(s).

Figure 2D:
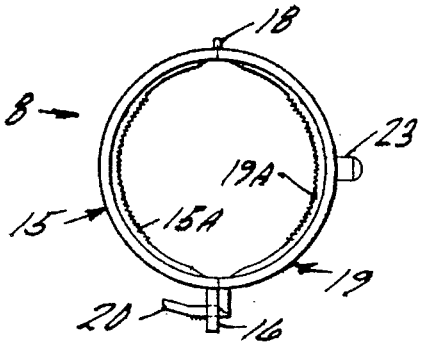
FIG. 2D illustrates a top view perspective of the latching device of FIG. 2B in a closed position.

FIG. 2D illustrates a top view perspective of the latching device 8 in the closed position. As seen in FIG. 2D, when the latching device 8 is in the closed position, the sections 15 and 19 are brought together as shown, and the connecting means 20 is engaged within and through the corresponding slot 47 of the connector 16 of the connecting section 15. As shown in FIG. 2D, the connecting regions 15A and 19A provide the ribbed portions 15B and 19B, respectively, along at least a portion of the interior region of the closed latching device 8.

Figure 3:
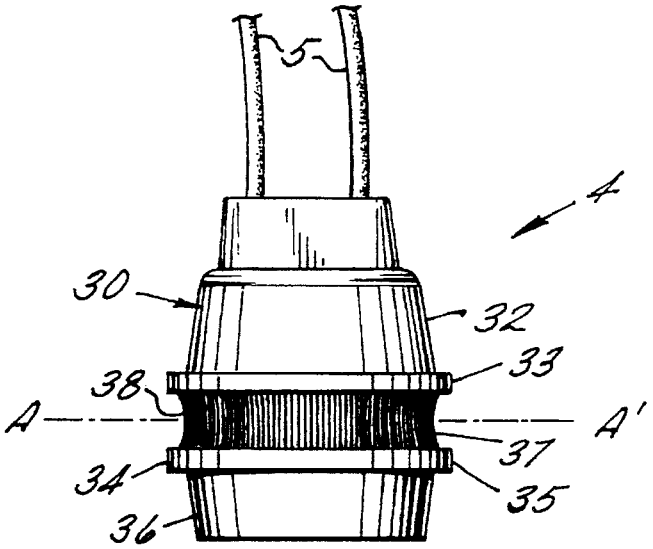
FIG. 3 illustrates a side view perspective of the socket assembly which is used in conjunction with the apparatus of the present invention.

FIG. 3 illustrates the socket assembly 4, which is utilized in conjunction with the light protector apparatus 1 of the present invention. With reference to FIG. 3, the socket assembly 4 comprises a socket body 30 which has two electric wires 5 attached at the top end thereof. It is important to note, however, that an electric cord or line may also be utilized in conjunction with the present invention. Further, any other suitable number of electric wires may also be utilized in conjunction with the present invention.

The socket body 30 comprises a plurality of molded sections which include an upper portion 32, a lower portion 34 and a midsection 37. The upper portion 32 has a rim 33 at the lower section thereof. The lower portion 34 has a rim 35 and a tapered lower section 36 which has a diameter which is less than that of the rim 35. The socket apparatus 4 has, located between the rim 33 and the rim 35, a midsection 37 which has a diameter less than that of the rims 33 and 35. The midsection 37 contains a plurality of ribs 38 which are formed thereon and which are located about at least a portion of the circumference thereof. The ribs 38 run, in length from the rim 33 to rim 35, as shown. As illustrated in FIG. 3, and as noted above, the diameters of each of the rims 33 and 35 are greater than the diameter of the ribbed midsection 37, which design feature facilitates the engagement and support of the socket assembly 4 with and by the latching device 8 of the cage assembly 2.

Figure 3A:
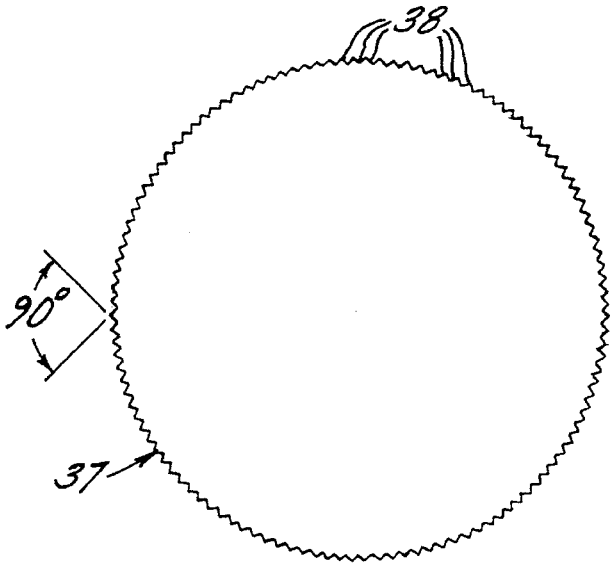
FIG. 3A illustrates a magnified sectional view of the socket assembly of FIG. 3 taken along line A—A' of the midsection of the socket assembly.

FIG. 3A illustrates a magnified sectional view, taken along line A—A'of the midsection 37 of the socket assembly 4 of FIG. 3, illustrating the ribs 38 from a top view perspective. In the preferred embodiment, the ribs 38 are formed as triangular shapes having a 90°angle. The ribs 38 are chosen and designed so as to coact with, and to interengage with, the ribs 15C and 19C of the latching device 8.

Figure 3B:
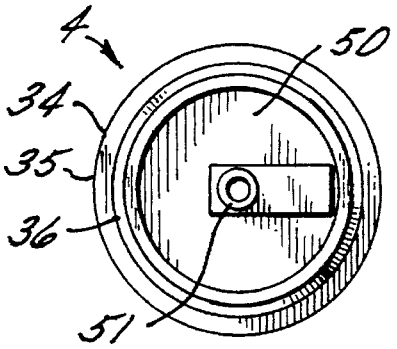
FIG. 3B illustrates a bottom view of the socket assembly of FIG. 3.

FIG. 3B illustrates a bottom view of the socket assembly 4. As illustrated in FIG. 3B, the socket assembly 4 has, on the bottom side thereof, socket 50 into which the light bulb or lighting element 3 is inserted and secured. The socket 50 has electrical contact(s) 51 located therein for providing an electrical power connection from the electric wires 5 to the light bulb or lighting element 3. The dimensions of the ribbed midsection 37 are chosen so as to be substantially equal to the inner diameter of the ribbed sections 15A and 19A of the closed latching device 8 so that the ribs 38 of the midsection 37, coact with, and interengage with the ribs 15C and 19C of the latching device 8 when the latching device 8 is attached about the midsection 37 of the socket apparatus 4, so that there is sufficient play and/or leeway between the respective ribs 38, 15C and 19C so that the latching device 8 and the midsection 37 of the socket assembly 4 are rotatable and moveable relative to one another.

The dimensions of the midsection 37 of the socket assembly 4 and the sections 15A and 19A of the latching device 8 should be selected so that the ribs 38 of the socket assembly 4, and the ribs 15C and 19C of the latching device 8 are capable of interengaging with one another so as to secure the latching device 8, and therefore, the cage assembly 2, about and to, the socket assembly 4, while allowing for sufficient play and/or leeway so that the latching device 8 and the socket assembly 4 are rotatable with respect to, and relative to, one another. In this regard, the dimensions of the ribs 38 of the midsection 37, and the ribs 15C and 19 of the latching device 8, should provide enough play and/or leeway so that the case assembly 2, via the latching device 8, may be rotatable in either direction about, and with respect to, the socket assembly 4.

Figure 4A:
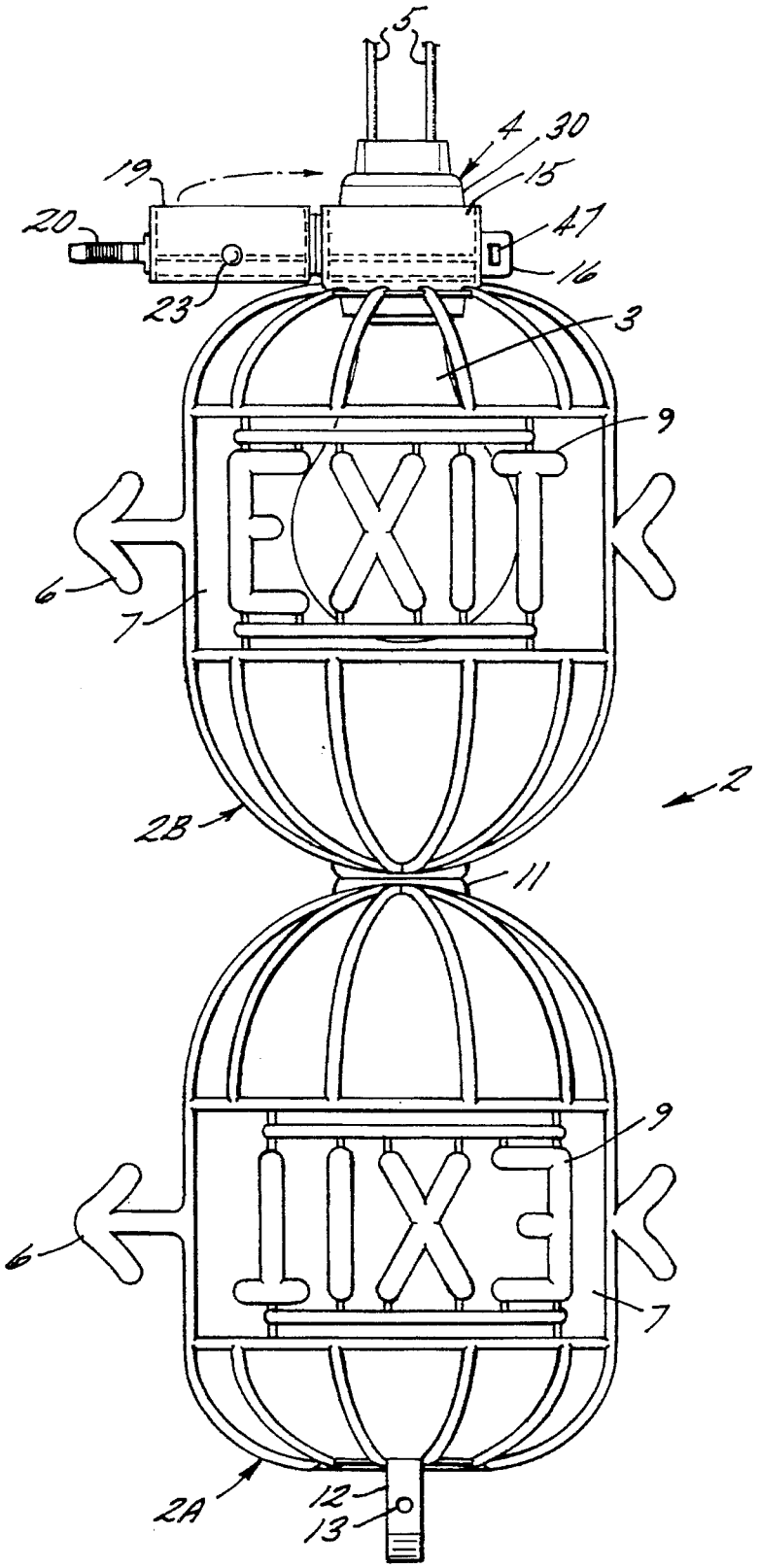
FIGS. 4A–4D illustrate the steps which are performed in assembling the light bulb or lighting element protector apparatus of the present invention.
Figure 4B:
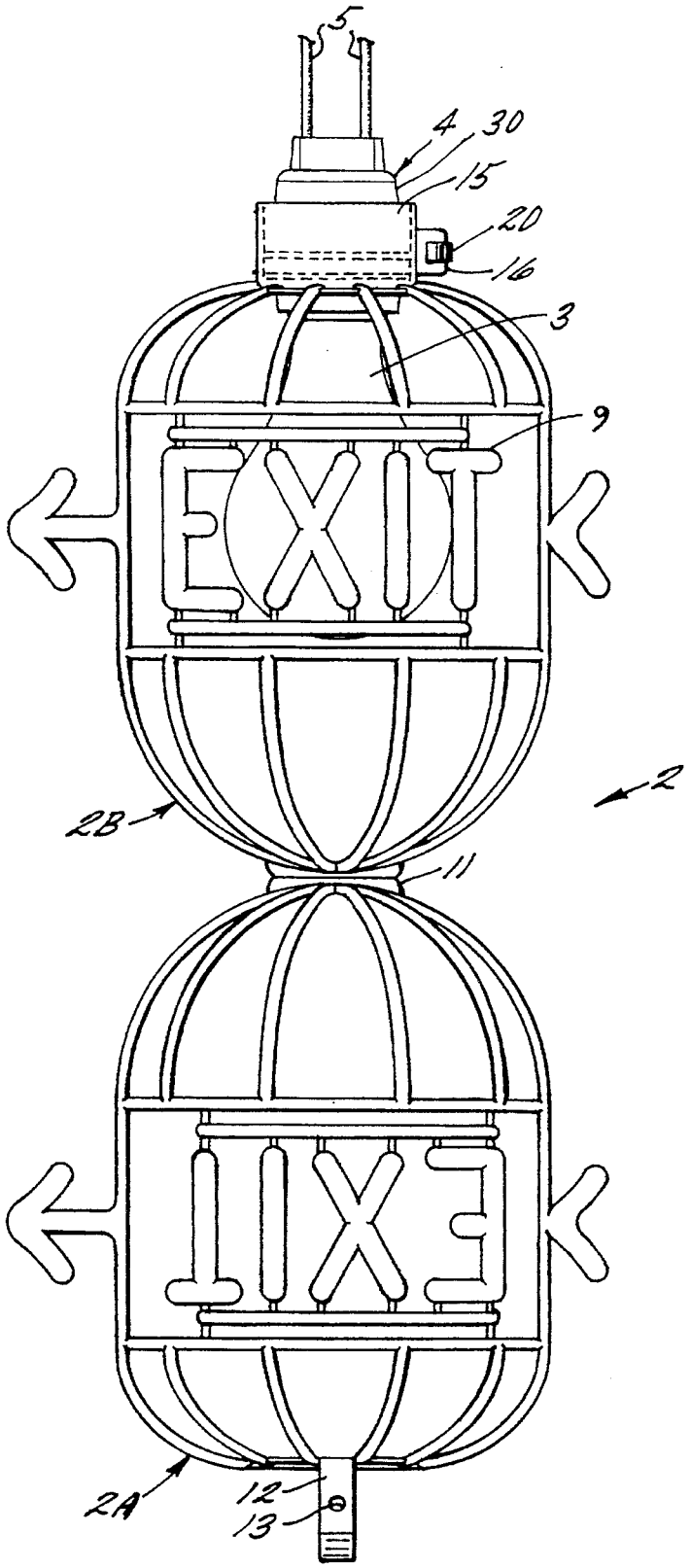

FIGS. 4A–4D illustrate the steps which are performed in assembling the light protector apparatus 1 of the present invention. Initially, the light bulb 3 must be inserted and secured within the socket 50 of the socket assembly 4. In FIG. 4A, the sections 15 and 19 of the latching device 8 are brought together about the midsection 37 of the socket assembly 4 as shown. In FIG. 4B, the connector device 20 is inserted into and through the hole 47 of the connector device 16. In this manner, the latching device 8 is connectable about the midsection 37 of the socket assembly 4. As noted above, the latching device 8 has an inner diameter which is smaller than the diameter of the rims 33 and 35 so as to prevent the latching device 8, and the cage assembly 2, from slipping off or from the socket assembly 4. It is also important to note that, in the preferred embodiment, the latching device 8 has a length which is substantially equal to the length of the midsection 37 so as to provide a secure attachment of the latching device 8 with the socket assembly 4. It is important to note that it is also possible to have a midsection 37 which has a greater length than the latching device 8.

Figure 4C:
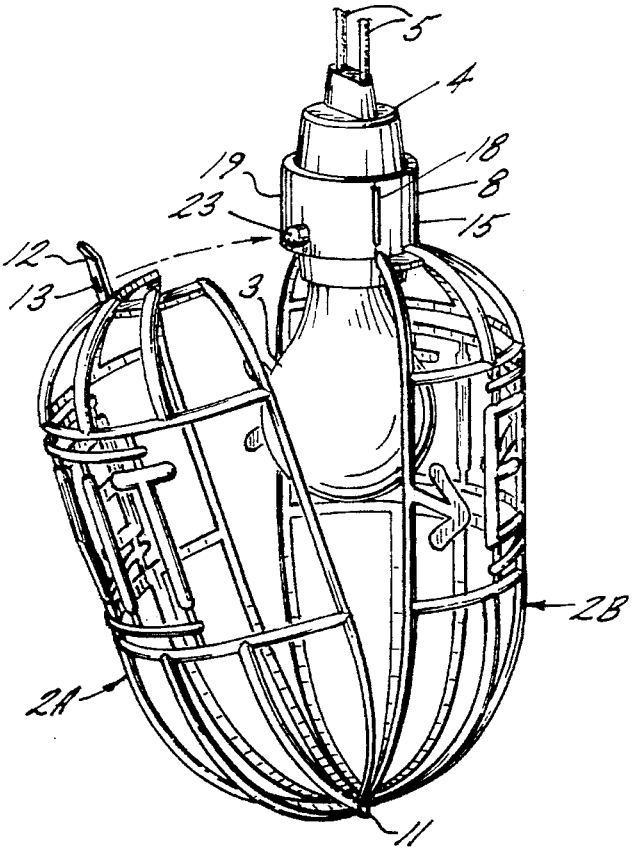
Figure 4D:
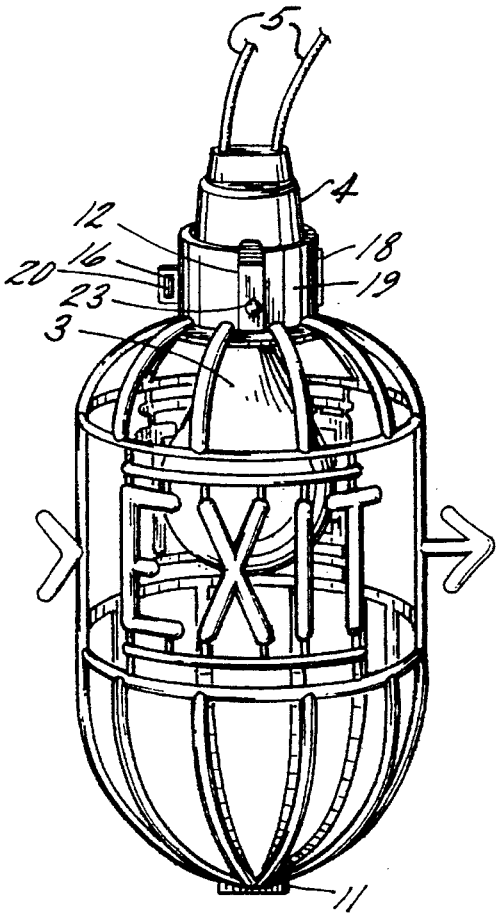

In FIG. 4C, the side half portion 2A of the cage assembly 2 is then folded at connector 11, towards the side half portion 2B until the side portion 2A and 2B are brought together. Once brought together, the side half portions 2A and 2B are attached to one another by mating the connecting hole 13 of the connector device 12 with the stud 23 of the moveable section 19. In FIG. 4D, the light protector apparatus 1 is shown fully assembled with the connecting device 12 of the side half portion 2A secured to the moveable section 19 of the latching device 8 by the mating of the connecting hole 13 with the connecting stud 23 of the moveable section 19. It can also be seen that the cage assembly 2 which is utilized with the present invention further facilitates an easy changing of a light bulb when such is necessary or desired.

Figure 5:
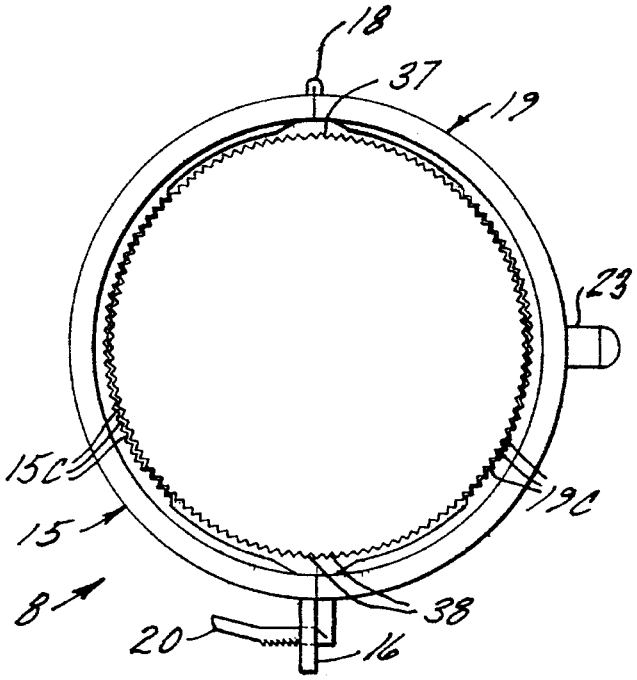
FIG. 5 illustrates a top view perspective of the relationship between the latching device and the midsection of the socket assembly in an assembled state.

FIG. 5 illustrates a top view perspective of the interaction and interengagement between the ribs 15C and 19C of the latching device 8 with the ribs 38 of the midsection 37 of the socket assembly 4. As can be seen in FIG. 5, once the latching device 8 has been fastened about the midsection 37 of the socket assembly 4, the ribs 15C and 19C of the latching device 8 and the ribs 38 of the socket assembly 4 interengage with each other with sufficient play and/or leeway so as to provide for a ratchet-like, mechanism and/or assembly. In this manner, the latching device 8 may be rotatable, relative to, and about the socket assembly 4.

With the light protector apparatus 1 assembled as described above, the cage assembly 2, and its attendant message and/or logo 9, which, in the preferred embodiment is the word "EXIT", along with the directional device 6, may be rotated about, and relative to, the socket assembly 4. In this manner, the latching device 8 and the socket assembly 4 serve to provide versatility in providing informative and/or directional information.

The light protector apparatus 1 may be utilized so as to provide informative, directional and/or other information in a variety of applications and environments such as in construction areas, in work zones, or in other areas or locations. The light protector apparatus 1, via its rotating latching device 8, may also be utilized so as to convey information from and to different vantage points.

Figure 6A:
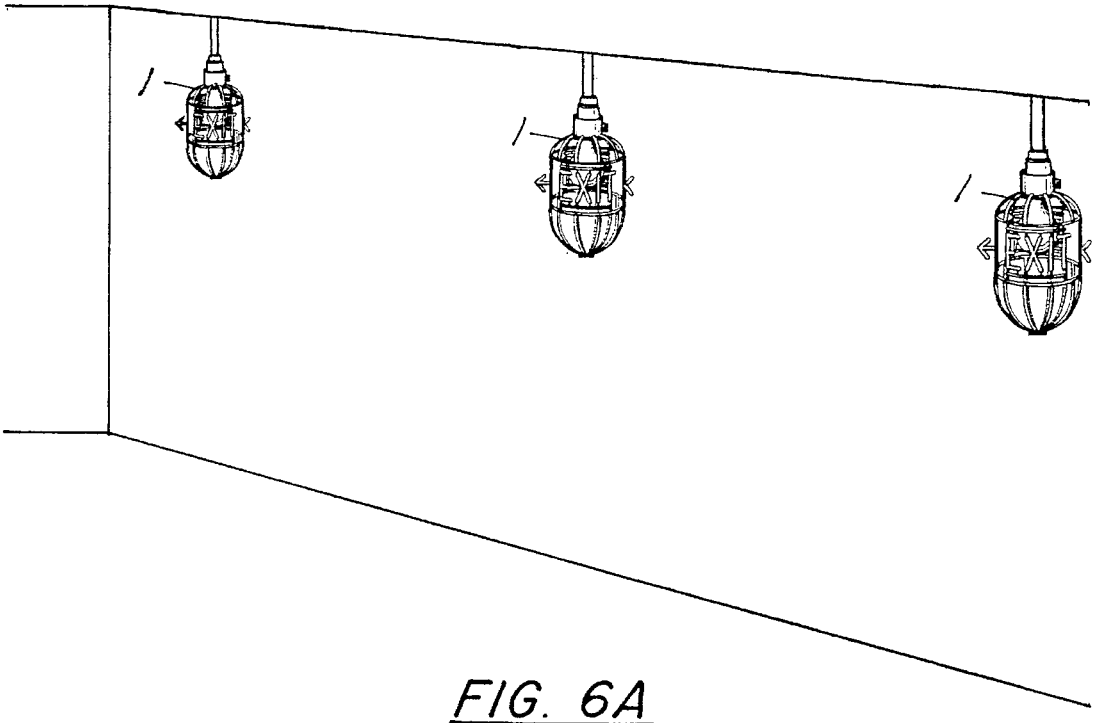
FIGS. 6A and 6B illustrate a typical manner and/or mode of use of a plurality of light bulb or lighting element protector apparatuses of the present invention which are therein utilized to illuminate and/or to provide information in a corridor.
Figure 6B:
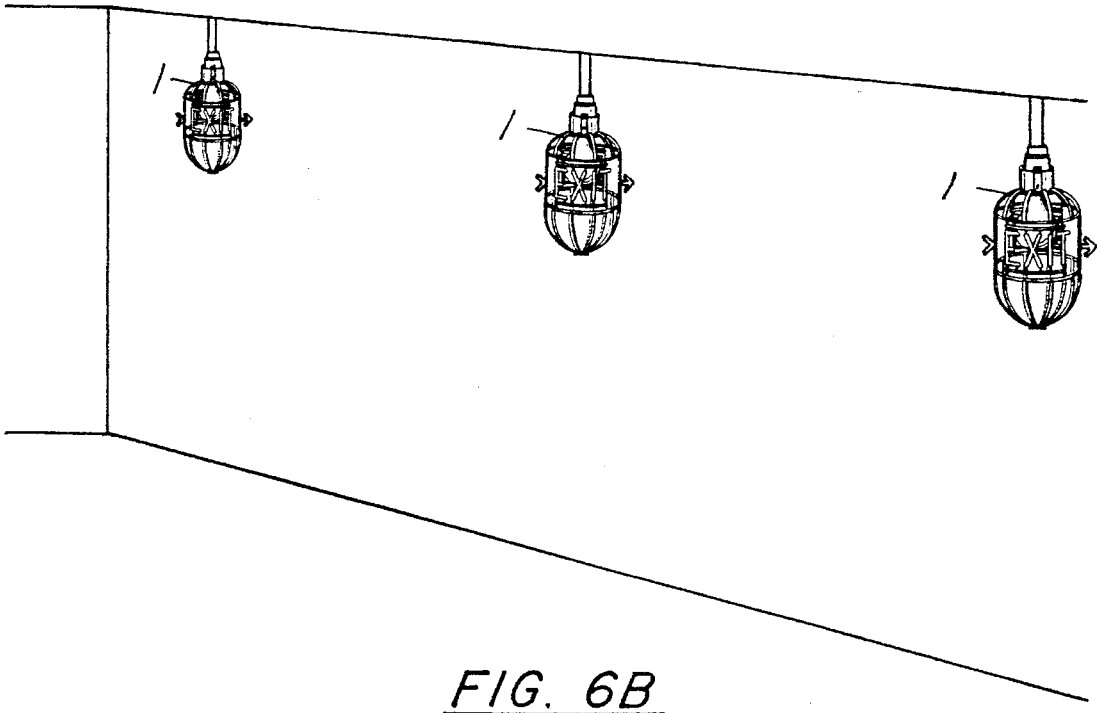

The light protector apparatus 1 of the present invention may also be utilized in conjunction with another apparatus 1 or with a plurality of apparatuses 1 so as to provide a series of, or continuous, information. FIG. 6A illustrates a typical manner of use wherein the apparatuses 1 may be employed to designate a safe exit direction or pathway such as in a construction area. The apparatus 1 may also be used to designate a pedestrian walkway. In this application, the cage assemblies 2 of each of the apparatuses 1 must be rotated and oriented so that the direction indicators 6 all point in the same direction, as shown in FIG. 6A. If an alternate or a different direction is then desired, the cage assemblies 2 may then be easily rotated until the direction indicators 6 are all pointing in the same alternate or different direction, as shown in FIG. 6B.

The cage assemblies 2 of the apparatuses 1 may also be rotated at will so as to allow for the display of the message and/or logo 9 and/or so as to provide a directional indication for any one or more of a number of positions or orientations. In this manner, the present invention provides for a versatile apparatus 1 for providing and/or conveying informative and/or directional information.

The apparatus 1 of the present invention may also be employed so as to provide a lighted pathway or path in a dark corridor. Further, since the cage assembly 2 may be made from a fluorescent and/or phosphorescent color or material, the apparatus 1 may also provide illumination by glowing in the dark when and if the light source is turned off, removed, or is otherwise rendered inoperable.

If the apparatus 1 is constructed from component parts, it is also possible to remove and/or to interchange the messages and/or logos 9 so as to convey different information. As noted above, the directional components may also be removed and/or interchanged if made separately.

In an alternate embodiment, the apparatus 1 of the present invention may be utilized in conjunction with a flashing device so as to provide for a flashing, or a strobe light-like, illumination from the light bulb or lighting element.

Figure 7:
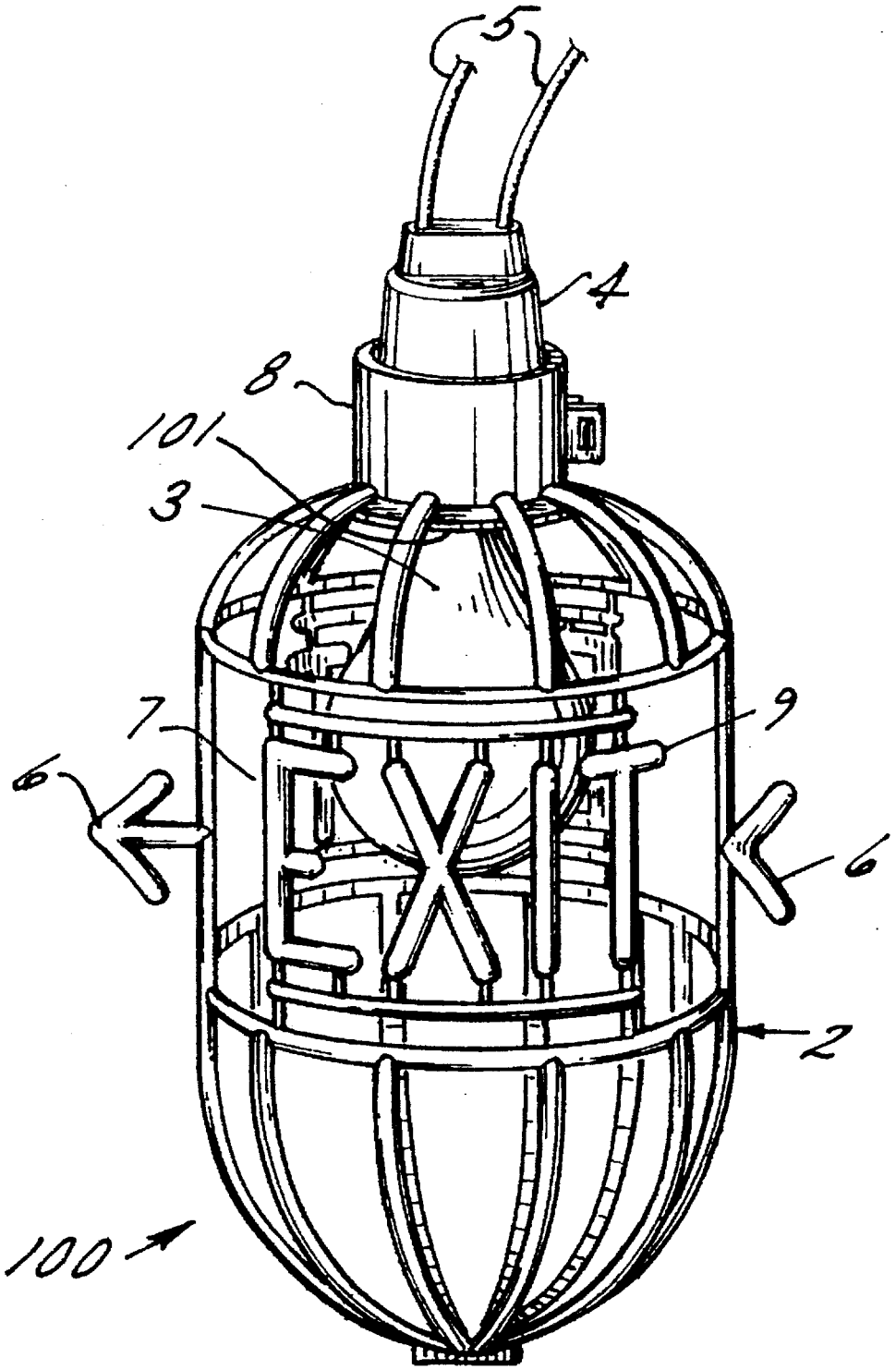
FIG. 7 illustrates an alternate embodiment of the light bulb or lighting element protector apparatus which utilizes a flashing and/or a strobing device.

FIG. 7 illustrates an alternate embodiment of the light protector apparatus of the present invention, which is designated by the reference numeral 100. In FIG. 7, the apparatus 100, comprises all of the elements as the apparatus 1 of FIG. 1 and further comprises a flashing device 101 which, in the preferred embodiment, receives the light bulb 5 and is inserted into the socket assembly 4. The flashing device 101 may also be built into the socket assembly 4.

The flashing device 101 may also be easily added to the apparatus 100 by connecting it at or near the power source, to the socket assembly 4 of the apparatus 100, or to any other appropriate location in the electrical circuit. In this regard, the apparatus 100 of the present invention will provide a flashing and/or a strobe light-like effect so as to accentuate and/or to further draw attention to the apparatus 100 and to the information which is intended to be provided and/or conveyed thereby.

Figure 8A:
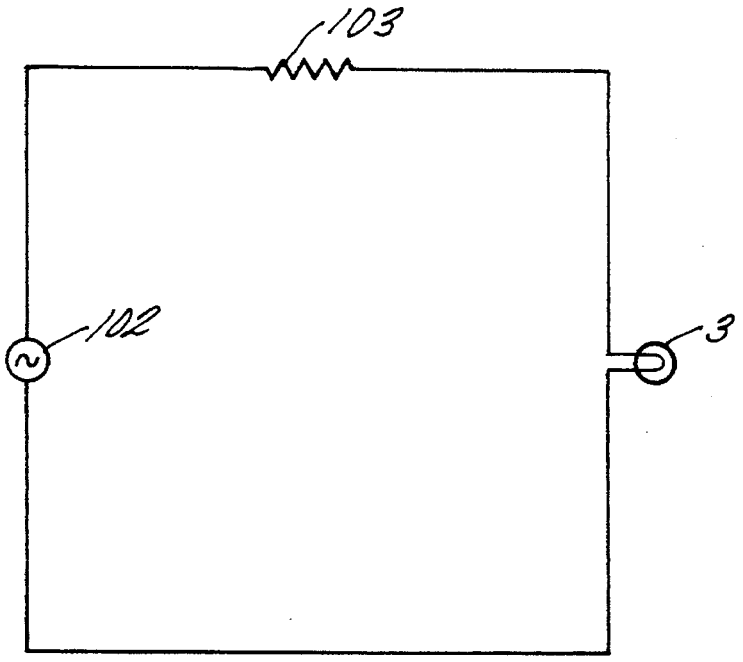
FIG. 8A illustrates a block diagram of a typical electrical circuit which is employed with the light bulb or lighting element protector apparatus of FIG. 1.
Figure 8B:
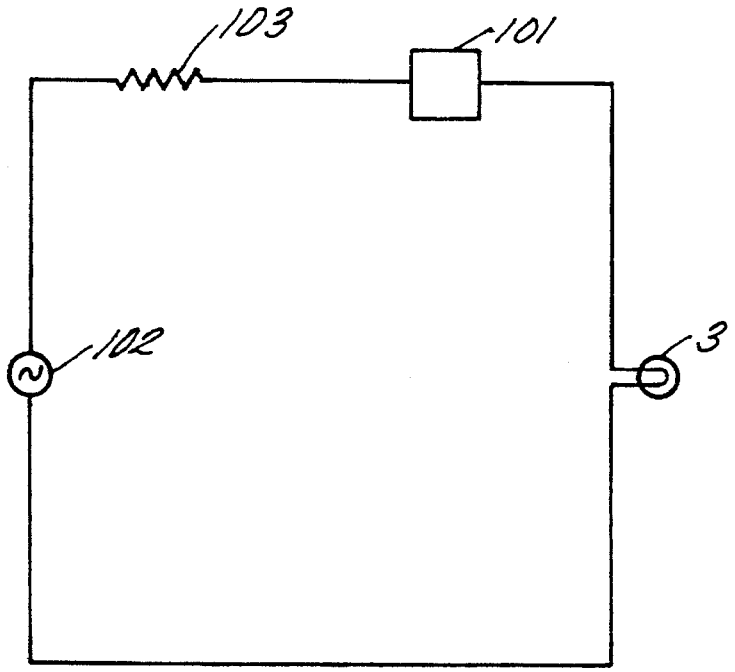
FIG. 8B illustrates a block diagram of a typical electrical circuit which is employed with the light bulb or lighting element protector apparatus of FIG. 7.

FIG. 8A illustrates an electrical block diagram of the apparatus 1 of FIG. 1. As noted above, the apparatus 1 of Figure 1 does not contain a flashing device. FIG. 8B illustrates an electrical block diagram of the alternate embodiment light protector apparatus 100 which utilizes the flashing device 101. As can be seen in FIG. 8A, the basic circuit includes an AC power source 102, an equivalent circuit resistance 103, and a light bulb 3. As illustrated in FIG. 8B, the apparatus 100 is comprised of the same components as the apparatus 1 of FIG. 8A and further comprises the flashing device 101, which is connected in series with the electrical supply source 102, the equivalent circuit resistance 103 and the light bulb 3. The flasher device 101 may also be connected with the lighting circuitry in any other suitable and/or appropriate manner so as to perform its function.

The flashing device 101 provides a means by which to facilitate a flashing and/or a strobing of the light bulb 3 by controlling and/or systematically interrupting the electrical power flow to the light bulb 3. In this regard, informative and/or directional information and/or messages may be further accentuated by a flashing light bulb or lighting element so as to more easily draw attention thereto.

While the present invention has been described and illustrated in various preferred embodiments, such are merely illustrative of the present invention and are not to be construed as limitations thereof. Accordingly, the present invention includes all modifications, variations and/or alternate embodiments with the scope of the present invention limited only by the claims which follow.

What is claimed is:

1. A protector apparatus for a light bulb, said apparatus comprising a socket assembly for receiving said light bulb, said socket assembly including a ribbed portion disposed about at least a portion of the periphery of said socket assembly;

a cage assembly including means for protecting said light bulb, said means including a message area with indicia and means for latching said cage assembly to said socket assembly including a ribbed portion interengagable with said ribbed portion of said socket assembly so as to be rotatable relative thereto;

said cage assembly being fluorescent or phosphorescent.

2. The protector apparatus of claim 1 wherein said cage assembly is formed from a moldable plastic material.

3. The protector apparatus of claim 2 wherein said cage assembly is a single molded assembly.

4.The protector apparatus of claim 1 wherein said cage assembly includes a direction indicator.

5. The protector apparatus of claim 4 wherein said direction indicator is an arrow.

6. The protector apparatus of claim 1 wherein said socket assembly includes means for flashing the light bulb.

* * * * *